US006067810A

United States Patent [19]

Jennings et al.

[11] Patent Number: 6,067,810

[45] Date of Patent: May 30, 2000

[54] CHILLED ITEM SERVER

[75] Inventors: Thomas A. Jennings, Winston-Salem; Theodore A. Pierce, Pfafftown; Eugene C. Pierce, Greensboro, all of N.C.; Christopher A. Onufrik, Carmel, N.Y.

[73] Assignee: Decision Point Marketing, Inc., Winston-Salem, N.C.

[21] Appl. No.: 09/221,888

[22] Filed: Dec. 28, 1998

[51] Int. Cl.[7] ..... A47F 3/04

[52] U.S. Cl. ..... 62/246; 62/457.2

[58] Field of Search ..... 62/246, 249, 457.1, 62/457.2, 457.7; 126/400; 165/10, 10 A, 502

[56] References Cited

U.S. PATENT DOCUMENTS

| | | | |
|---|---|---|---|
| 309,233 | 12/1884 | Luhmann . | |
| 608,701 | 8/1898 | Morse . | |
| 2,453,017 | 11/1948 | Kaufman | 62/133 |
| 2,612,761 | 10/1952 | Hilker | 62/457.2 |
| 3,130,163 | 4/1964 | Avera | 252/67 |
| 3,254,502 | 6/1966 | Ellis | 62/457.1 |
| 4,220,048 | 9/1980 | Grepiotis et al. | 73/323 |
| 4,319,629 | 3/1982 | Hotta | 165/47 |
| 4,348,827 | 9/1982 | Brinker | 40/607 |
| 4,722,199 | 2/1988 | Hibino | 62/344 |
| 4,724,682 | 2/1988 | Flum et al. | 62/462 |
| 4,910,975 | 3/1990 | Derby | 62/372 |
| 4,923,077 | 5/1990 | Van Iperen et al. | 220/3.1 |
| 4,946,032 | 8/1990 | Stoddard et al. | 206/44 |
| 4,982,840 | 1/1991 | Bidwell et al. | 206/223 |
| 4,995,238 | 2/1991 | King | 62/125 |
| 5,048,171 | 9/1991 | Bidwell et al. | 29/401.1 |
| 5,048,305 | 9/1991 | Taub | 62/372 |
| 5,101,642 | 4/1992 | Alexandrov | 62/371 |
| 5,169,020 | 12/1992 | Spamer | 220/444 |
| 5,261,253 | 11/1993 | Spenard | 62/250 |
| 5,313,807 | 5/1994 | Owen | 62/457.3 |
| 5,433,085 | 7/1995 | Rogers | 62/372 |
| 5,596,880 | 1/1997 | Welker et al. | 62/372 |
| 5,669,233 | 9/1997 | Cook et al. | 62/457.2 |
| 5,704,485 | 1/1998 | Cautereels et al. | 206/546 |

*Primary Examiner*—William E. Tapolcai
*Attorney, Agent, or Firm*—Rhodes & Mason, PLLC

[57] ABSTRACT

A chilled item server is disclosed including an outer barrel formed of thermoplastic material that has a generally cylindrical shape, substantially vertical sides, a generally flat, closed bottom, and an open top having an annular ledge. An inner liner fits within the outer barrel and has a generally elongated truncated pyramidal shape, a generally flat bottom, an open top with an extended rim formed to compliment the generally square opening shape of the outer barrel and to rest on the annular ledge. A chamber is located between the inner liner and the outer barrel and is filled with polystyrene foam. At least one freezer panel is formed of appropriate size and shape to fit within the inner liner. The freezer panel is formed of thermoplastic material and arranged in a syncline. The freezer panels have cavities within each freezer panel that is filled with 2% saline solution. Casters are mounted to the generally flat bottom of the outer barrel. Graphics are printed on styrene that is wrapped, and secured to the outer barrel. Thereafter, beverages are placed within the server and subjected to the cool atmosphere created within the server by the freezer panel and thereafter maintained at an effective temperature for consumption.

26 Claims, 6 Drawing Sheets

CHILLED ITEM SERVER

BACKGROUND OF THE INVENTION

This invention relates generally to insulated containers for the protection of temperature sensitive goods and more particularly to an insulated container for the display and sale of milk in school cafeterias.

Generally, for keeping temperature-sensitive foodstuffs, especially beverages, chilled, either an electrically refrigerated cabinet or an insulated container filled with ice has been used. For example, as a student passes through the lunch line he/she usually passes a large electrically refrigerated cabinet filled with cartons of milk. Also, convenience stores generally have point-of-sale insulated containers filled with iced-down beverages. There are numerous problems associated with either method of cooling individually packaged beverages.

Electrically refrigerated cabinets are large, cumbersome units with many faults. The large nature of the cabinets makes them particularly unsuited for young students who are not tall enough and cannot access the milk or other products inside the unit. The units are not easily movable and this prevents convenient rearrangement of the lunch line as needed. These cabinets generally require a substantial capital investment on the part of the school district. Additionally, as with other similar appliances, the units require periodic maintenance. If the unit fails or a power outage occurs, the units are completely ineffective during the interim.

As a solution to the aforementioned shortcomings to an electrically refrigerated unit insulated beverage coolers have been made that chill the beverages with ice in an attractive display. These coolers are basically large tubs that hold individually packed beverages together with ice, thus keeping the beverages in contact with the ice and cooled. Although these coolers are generally more mobile and convenient, they also are fraught with drawbacks.

Placing food or beverages on ice, although the food or beverage may be individually packaged, allows for the opportunity for contamination to the food or beverage by the melted ice. Sometimes the preferred product is packaged in a carton, like milk, and the carton becomes soggy after prolonged contact in ice and melted water. The melted ice may splash and spill out of the cooler, thus creating a slip-and-fall hazard. The beverages eventually may become completely immersed within the ice and water. This is inconvenient and also presents a health risk due to the spread of germs within the ice and water mixture. The accumulation of water as a cooling medium has the undesirable effect of impairing the degree of sanitation achievable and maintainable.

There is a need, therefore, for a chilled beverage container that can maintain the required cooling effect on its contents while being mobile, efficient, sanitary, and inexpensive.

SUMMARY OF THE INVENTION

The present invention provides a chilled item server formed of lightweight durable polymer. The server is made of an outer barrel of any appropriate thermoplastic formed to hold an inner liner. Prior to placing the inner liner within the outer barrel, a foaming fixture defines the inside face of an insulating body made of insulating material between the inner liner and the outer barrel. Particulate material between the fixture and the outer barrel is processed to form a fused foam between the barrel and the fixture. The fixture can then be replaced by the inner liner. The inner liner has an inner surface suitable for the insertion of multiple freezer panels, such that freezer panels thereafter are in juxtaposition with the inner surface. The freezer panels are molded polymer panels filled with cooling agent, such as saline solution, that can be frozen in a suitable freezer.

The items to be chilled and displayed may be placed within the combined barrels. The freezer panels cool and maintain the items at a preferred chilled temperature. The insulating material serves to maintain the chilled temperature and also retard thawing of the freezer panels. The freezer panels are reusable and easily cleaned and maintained. The entire barrel is also easily cleaned and sanitized as needed. The barrel may be mounted on casters to allow for convenient mobility of the barrel, either full or empty. Preferably the inner dimensions, after the insertion of the freezer panels, allows for two standard milk crates, each containing 96½-pint milk cartons, to be placed within the barrel. The outer dimensions can be adjusted accordingly to accommodate shorter or handicapped students. The freezer panels slowly thaw and may thereafter be replaced with fully frozen panels. The amount of condensation is minimal and does not produce the problems associated with using ice in direct contact with the food or beverage item.

The invention also provides an improved vending process for milk in school cafeterias.

The invention also provides an improved vending process for diary products in grocery or convenience stores.

DETAILED DESCRIPTION OF THE PREFERRED EMBODIMENT

Figure 1:
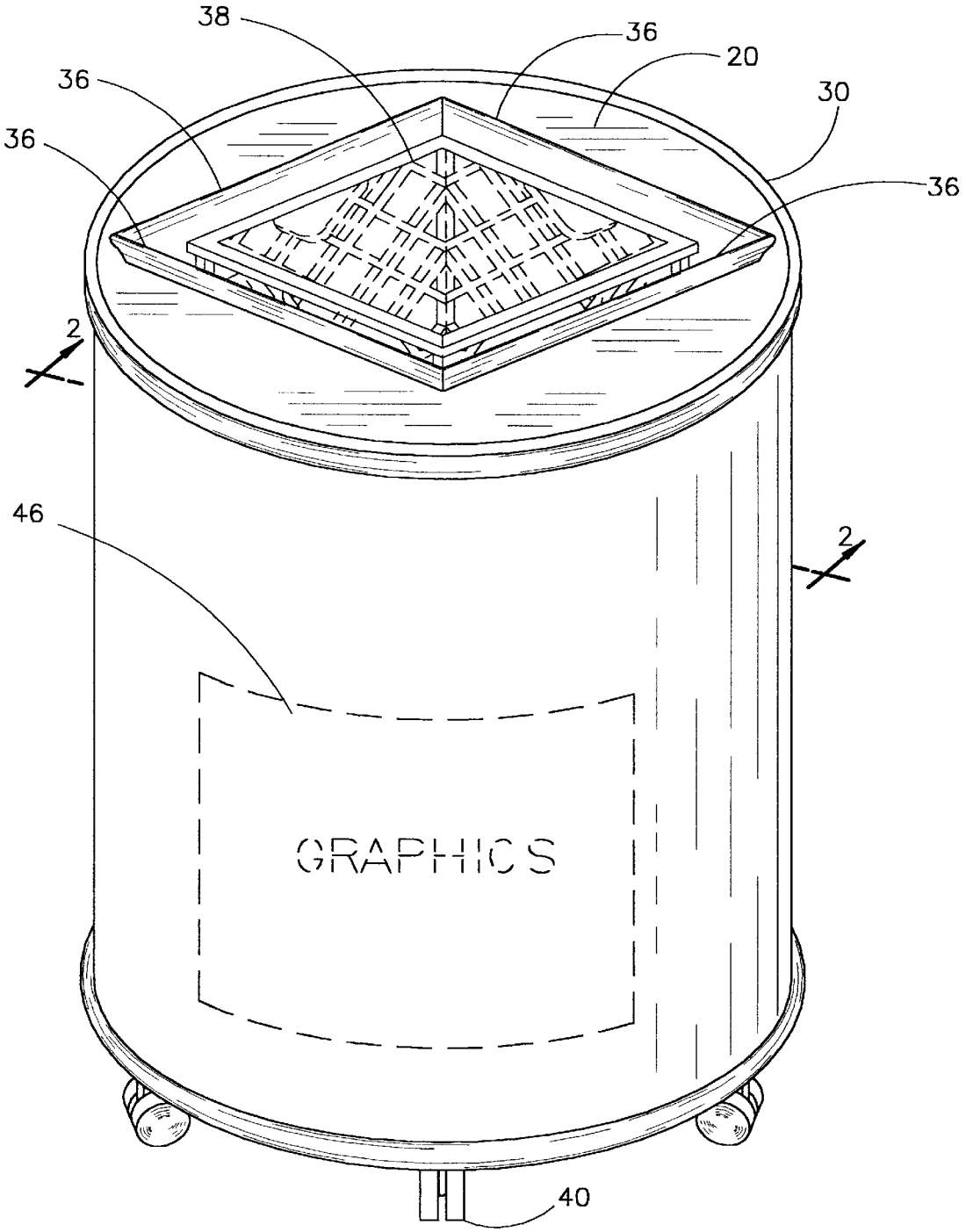
FIG. 1 is a perspective view of a chilled item server in accordance with the preferred embodiment of the invention.

Referring now more specifically to the drawings, FIG. 1 illustrates the preferred embodiment of the chilled item server 10.

Figure 2:
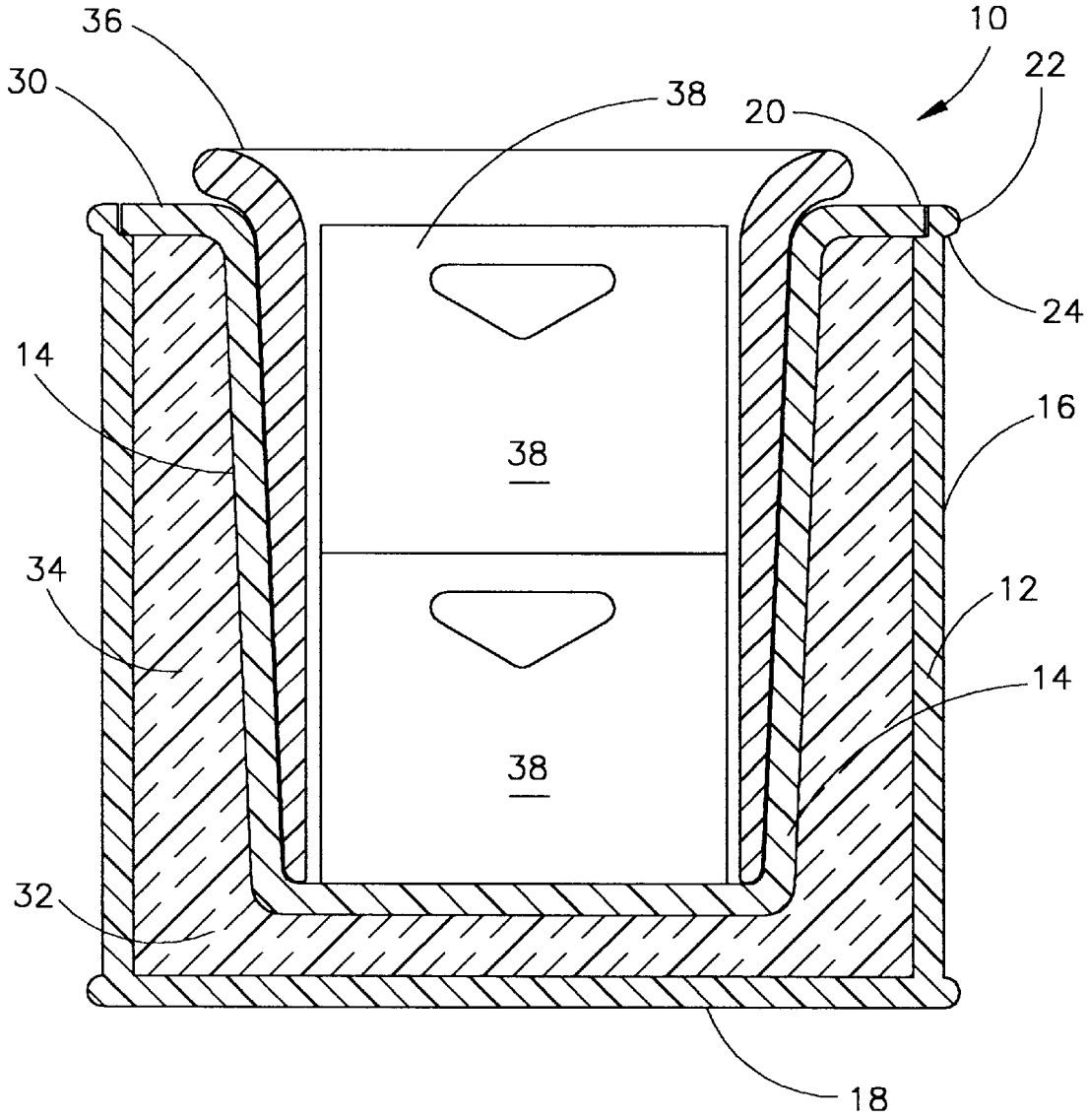
FIG. 2 is a sectional view taken along the lines 2—2 in FIG. 1 and looking in the direction of the arrows.
Figure 5:
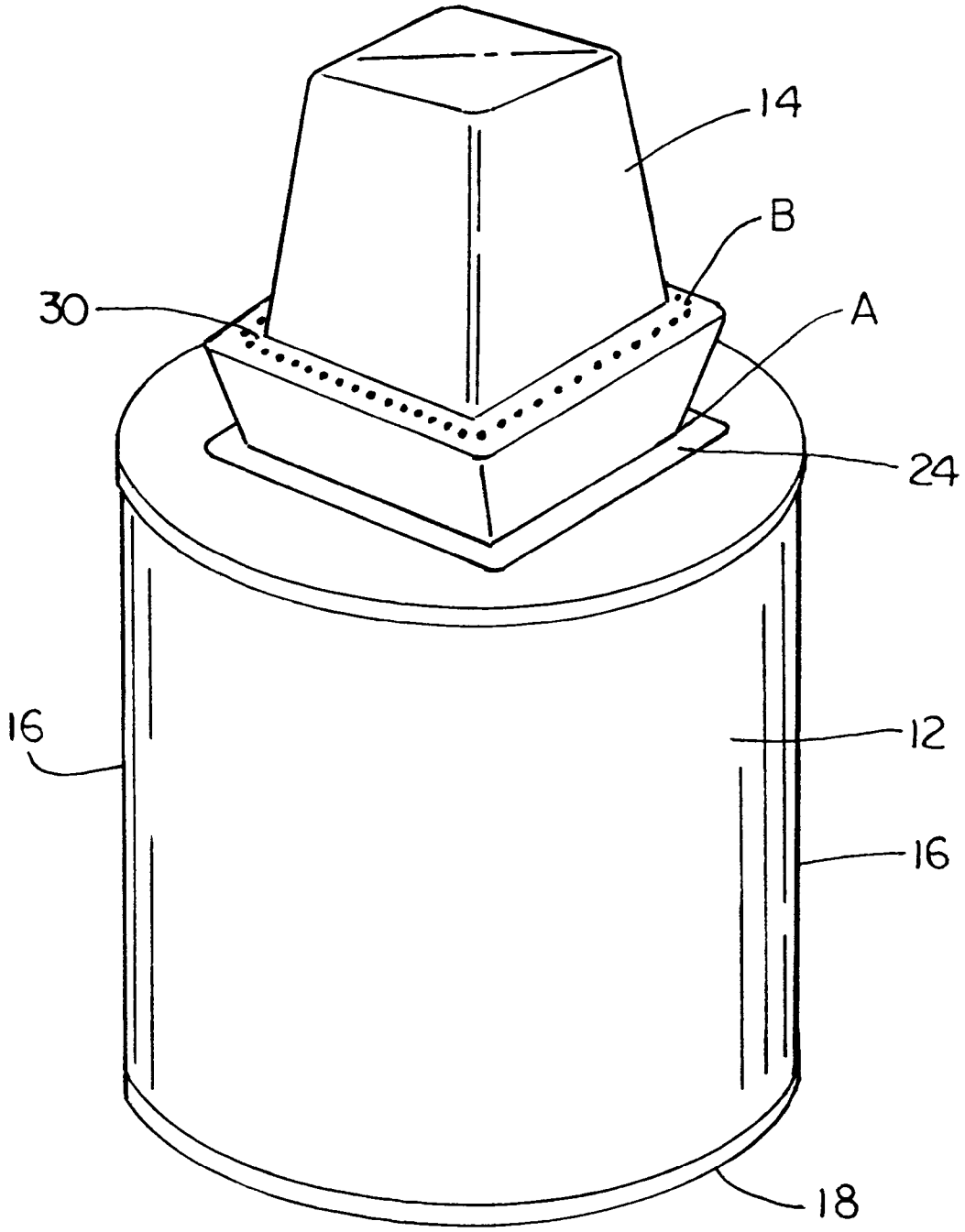
FIG. 5 is a perspective view of an intermediate blow molded item used in making the chilled item server in accordance with the present invention.

As shown in FIGS. 2 and 5 the outer barrel 12, and the inner liner 14 of the chilled item server 10 are constructed of any suitable material but preferably is made of thermoplastic material and most preferably polyethylene. The outer barrel 12 preferably is substantially outwardly cylindrical with generally vertical sides 16, a closed bottom 18 that has a flat outer surface and an open top 20. As shown particularly in FIG. 2, the rim 22 of the outer barrel 12 is formed with an inwardly extending annular ledge 24. The annular ledge 24 may extend inwardly more than is shown in FIG. 2, as will be apparent from the discussion below with respect to FIG. 5. The outer diameter of the outer barrel 12 is preferably about 26 inches. The height of the outer barrel 12 is dependent upon the targeted consumer of the beverage to be held in the server 10. If the server 10 is to be used in an elementary school cafeteria, the height should be about 26 inches to facilitate smaller children reaching into the server 10 to get milk. For secondary and high schools, however, the outer barrel 12 is preferably about 36 inches in height.

As shown in FIG. 2, an inner liner 14 is fit within the outer barrel 12. The inner liner 14 preferably is substantially in the shape of an elongated truncated pyramid with a substantially flat bottom 28 and an extended rim 30 formed to complement the shape of opening 20 of the outer barrel 12. As shown in FIG. 2, the rim 30 of the inner liner 14 rests upon the annular ledge 24 of the outer barrel. The dimensions of the inner liner 14 are determined in part from the size of a milk crate 38 to be stored therein. The inner height of the inner liner 14 is preferably about 21¾ inches and the length of the substantially square inner walls is preferably about 15⅝ inches.

When the inner liner 14 and outer barrel 12 barrel fit together, a chamber 32 is created as the space between the outer surface of the inner liner 14 and the inner surface of the outer barrel 12. It is preferred that insulating material 34 fill this chamber 32.

Figure 6:
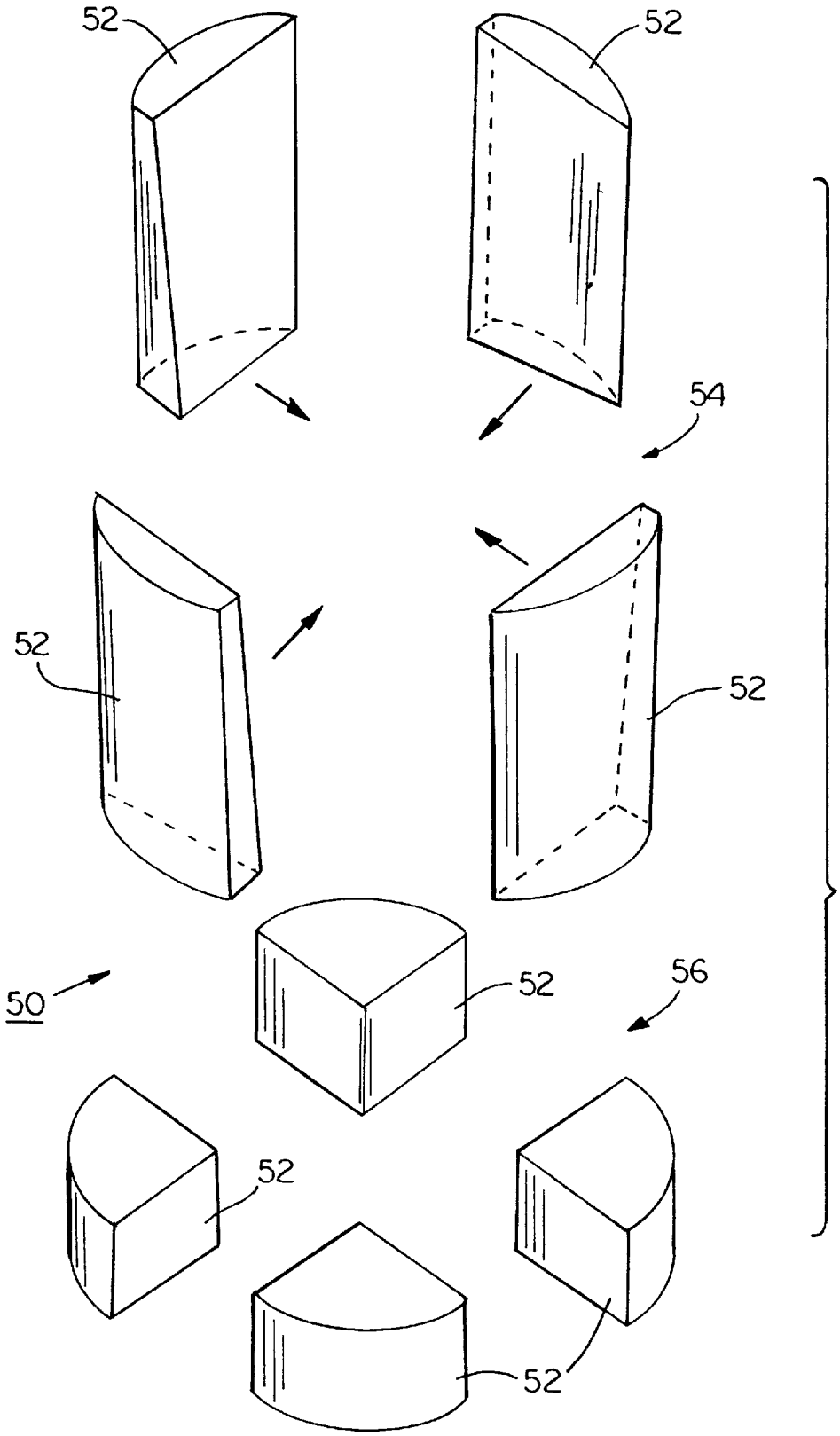
FIG. 6 is an exploded view of the preferred insulating assembly within the present invention.

The preferred insulating assembly 50 is illustrated in FIG. 6. Preformed sections 52 are made by a conventional styrofoam molding process wherein polystyrene beads having gas cores are placed in a mold of appropriate form. The polystyrene material is heated by injecting steam to expand the gas cores to form a fusing of the beads together. The preformed sections 52 are then assembled within outer barrel 12 to fill the chamber 32. The sections are appropriately formed to fit the upper 54 and base 56 sections within the chamber 32. This assembly method is preferred because the inner liner 14 is not exposed to the heat of the steam and therefore experiences little to no distortion.

Another method to make the insulating material is to use an aluminum foaming fixture of appropriate form inserted into the outer barrel 12. Again, a conventional styrofoam molding process may be used in which polystyrene beads 34 having gas cores are placed between the fixture and the outer barrel 12 and the polystyrene material is heated by injecting steam to expand the gas cores to form a fusing of the beads together. Then, the fixture is removed and the inner liner 14 inserted into the outer barrel 12. In this manner, the inner liner 14 experiences minimal distortion due to the heat of the steam. Other insulating material and methods may be used as recognized by those skilled in the art.

As shown in FIG. 5, it is preferred that the inner liner 14 and the outer barrel 12 are formed through conventional blow molding. The outer barrel 12 is formed with annular ledge 24. The inner liner 14 and outer barrel 12 are separated at point A. Then inner liner 14 is trimmed peripherally at point B. In this manner, inner liner 14 is formed with extended rim 30 to fit annular ledge 24.

As seen in FIGS. 1 and 2, the inner liner 14 is formed of a suitable size and configuration to hold a plurality of freezer panels 36 and two conventional milk crates 38. Each freezer panel 36 preferably is formed by conventional blow molding of thermoplastic material. After forming, the freezer panel 36 is preferably filled with approximately a 2% saline solution. For use, the freezer panels 36 are frozen and placed within the inner liner 14. Each freezer panel 36 may be individually frozen. The frozen panels 36 will provide sufficient cooling of the beverages placed within the server 10 due to the slow rate of thaw of the saline solution. Upon complete thawing, the thawed freezer panel is replaceable with a frozen panel, and the thawed panel may be re-frozen. Due to the recyclable nature of the freezer panels 36, the server provides a highly efficient and cost effective method of displaying milk for sale in school cafeterias.

Figure 3:
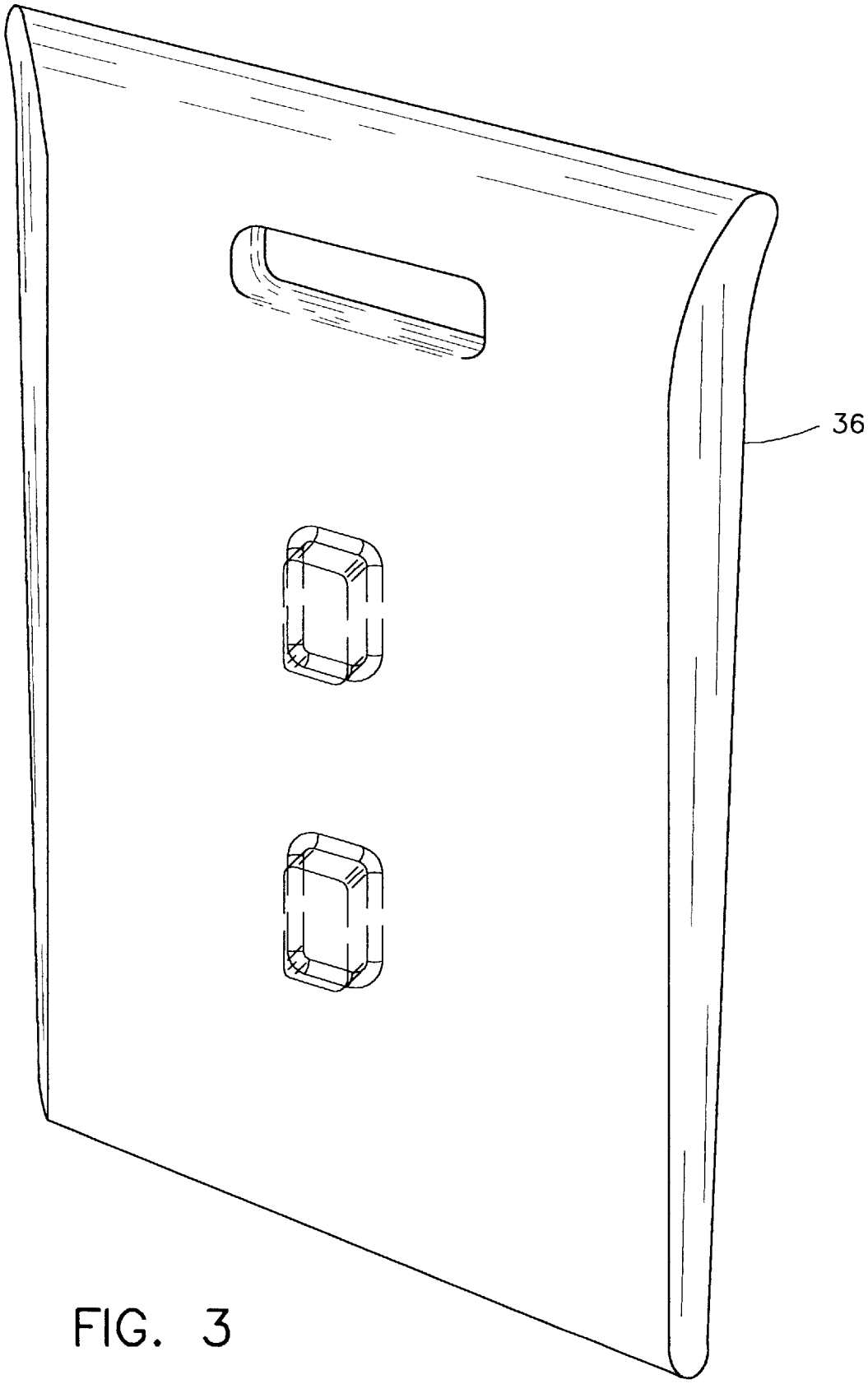
FIG. 3 is a perspective view of a panel component of the embodiment of FIG. 1.
Figure 4:
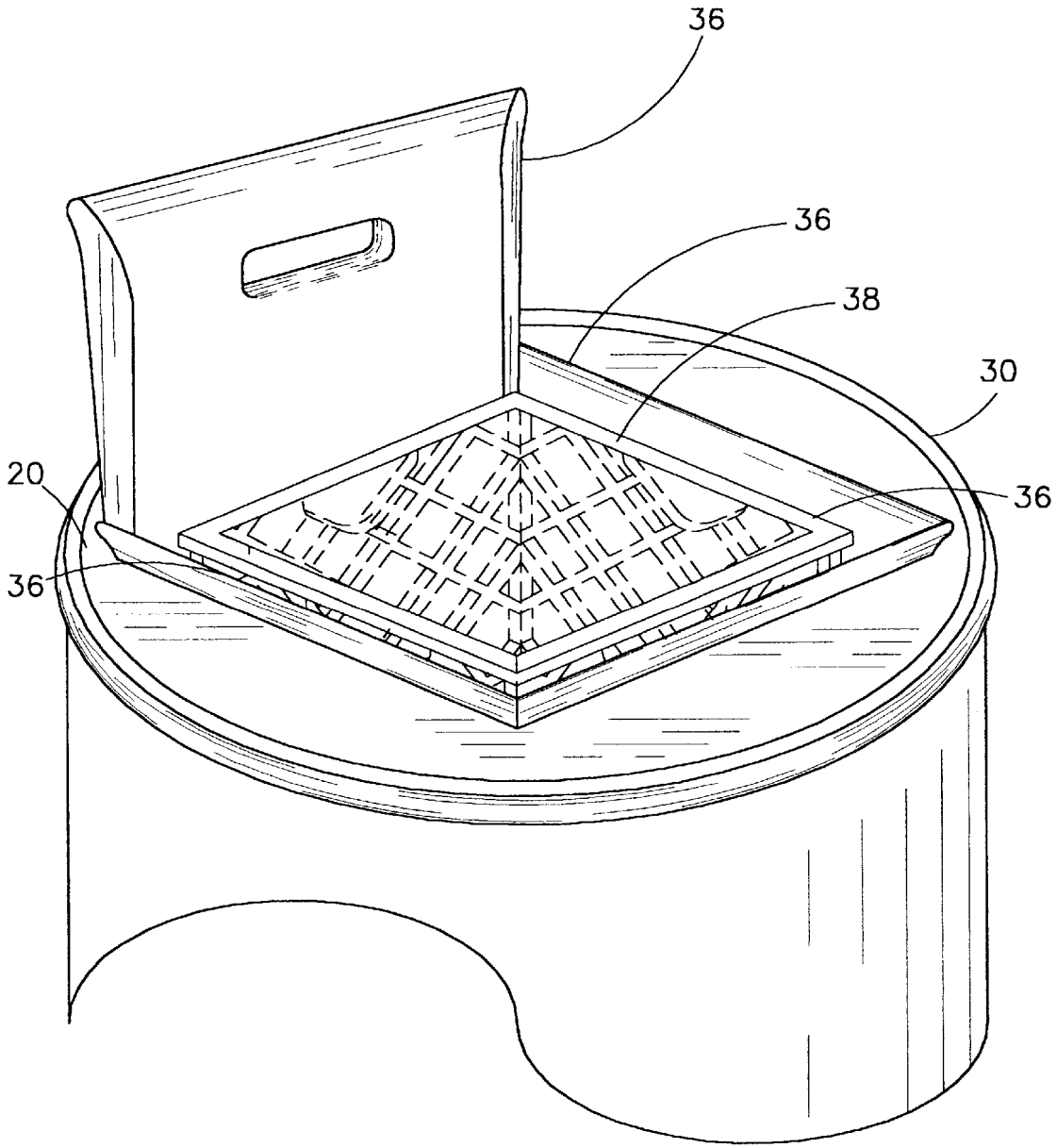
FIG. 4 is a perspective view of the embodiment of FIG. 1 showing the process of replacing panels.

Each freezer panel 36 preferably is formed so four panels define a periphery in contact with the entire upright inner surface of the inner liner 14. As shown in FIG. 3, each freezer panel preferably is substantially rectangular, about 16 inches wide by 22¾ inches high. Each panel 36 is preferably mitred along each vertical edge to form a complementary fit with other adjacent panels. Also, each panel 36 is preferably wider at the top, approximately 1 inch, and gradually decreases in width toward the bottom, approximately ⅝ inch, having a syncline profile. Each panel 36 preferably is formed with a handle 42 and a plurality of bosses 44 at which the front and rear faces of the panel are joined to prevent bowing or other panel distortion as the liquid inside expands upon freezing. FIG. 3 illustrates a panel 36 with six indentations of about 1½ inches in diameter with a depth of between about ⅞ to about ⅝ inch, dependent upon placement of the indentation due to the varying width of the panel 36.

As shown in FIG. 1, preferably four freezer panels 36 fit together to form the inner surface of the server 10. Thereafter, two conventional milk crates 38, each carrying 96½-pint milk cartons are vertically stacked into the server 10. The freezer panels 36 are removable and replaceable with freshly frozen panels even while the milk crates 38 remain within the server 10.

As shown in FIG. 1, preferably casters 40 are mounted to the bottom of the outer barrel 12 to ease mobility of the server 10. Also in FIG. 1, the server 10 is illustrated with graphics 46, for example light gauge styrene sheeting that is printed, wrapped, and secured to the outer barrel 12.

The server 10 makes for an improved display for the sale of milk in school cafeterias. The server 10 maintains the milk at an effective temperature for safe storage and consumption. The server provides sufficient cooling of milk without the need for ice or electricity. Further, the convenient and accessible nature of the server provides an attractive inducement for purchasing milk products.

Although the preferred embodiment concentrates on the sale of milk in school cafeterias, the invention should not be limited thereto. Other vendors may profit from this server 10 as well. For example, the server 10 may be used in a grocery or convenience store with similar graphics shown in FIG. 1 to display various dairy products. The server 10 allows for the independent display of dairy products apart from other beverages to highlight the nutritional nature of dairy products, in general. In addition, the server 10 allows vendors of other beverage products, such as soda, to place the beverages in an attractive and competitive display without the need for ice or electricity.

Although several embodiments of the present invention have been illustrated and described in detail, it is to be expressly understood that the invention is not limited thereto. The above detailed description of the embodiment is provided for example only and should not be construed as constituting any limitation of the invention. Modifications will be apparent to those skilled in the art, and all modifications that do not depart from the spirit of the invention are intended to be included within the scope of the appended claims.

We claim:

1. A chilled item server comprising:

an outer barrel with a rim;

an inner liner fitted within the outer barrel having a rim in communication with the rim of the outer barrel thereby creating a chamber between the inner liner and outer barrel;

insulating material within the chamber; and a plurality of separately removable panels interposed within the inner liner, said panels being freezeable with a slow rate of thaw and arranged to define a boundary substantially entirely around an inner cavity and further comprising means thereon to facilitate removal thereof from the server for refreezing.

2. The chilled item server of claim 1 further comprising:

casters mounted to a bottom portion of the outer barrel.

3. The chilled item server of claim 1 wherein the insulating material within the chamber is preformed polystyrene foam.

4. A chilled item server comprising:

an outer barrel with a rim;

an inner liner fitted within the outer barrel having a rim in communication with the rim of the outer barrel thereby creating a chamber between the inner liner and outer barrel;

insulating material within the chamber; and a plurality of removable panels interposed within the inner liner, said panels being freezeable with a slow rate of thaw and having a plurality of bosses on each of the plurality of panels such that the indentations prevent bowing of the panel upon sequential freezing and thawing.

5. The chilled item server of claim 1 wherein the outer barrel is substantially cylindrical and has a generally square, open top with an inwardly extending annular ledge and a generally round closed bottom.

6. The chilled item server of claim 5 wherein the inner liner conforms with the substantially square opening of the outer barrel and is configured to receive substantially square crates packed with the items to be chilled.

7. A chilled item server comprising:

an outer barrel with a rim wherein the outer barrel is substantially cylindrical and has generally square, open to with an inwardly extending annular ledge and a generally round closed bottom;

an inner liner fitted within the outer barrel having a rim in communication with the rim of the outer barrel thereby creating a chamber between the inner liner and outer barrel;

insulating material within the chamber; and a plurality of removable panels interposed within the inner liner, said panels being freezeable with a slow rate of thaw;

wherein the inner liner conforms with the substantially square opening of the outer barrel and is configured to receive substantially square crates packed with the items to be chilled and the inner liner has a substantially rectangular outer surface, an open top, a peripherally outward extending rim that communicates with the rim of the outer barrel, a substantially rectangular inner surface extending downwardly to a closed bottom whereby multiple substantially square crates packed with items are stackable within the inner liner.

8. The chilled item server of claim 6 wherein the outer barrel has an outer rim diameter of about 26 inches and a height of about 36 inches and the inner liner has a width of about 15⅝ inches and a depth of about 21¾ inches.

9. The chilled item server of claim 6 wherein the outer barrel has an outer rim diameter of about 26 inches and a height of about 26 inches and the inner liner has a width of about 15⅝ inches and a depth of about 21¾ inches.

10. The chilled item server of claim 1 wherein the plurality of panels are each an enclosed rectangle having a syncline profile containing about 2% by weight of saline solution.

11. The chilled item server of claim 6 wherein the plurality of panels are mitred such that upon placement of the panels within the inner liner the resulting inner surface of the chilled item server is essentially the surface of the placed panels whereby the sides of the items to be chilled are exposed only to the panels.

12. A method of vending milk in a school cafeteria comprising:

providing an insulated vessel having an internal, upwardly-open cavity;

freezing flat panels that are shaped and sized to fit along peripheral portions of the cavity;

placing the flat panels in the cavity along peripheral portions of the cavity to form a reduced cavity bounded substantially entirely by frozen panels;

depositing a crate packaged with cartons of milk within the reduced cavity, thereby storing the cartons of milk at a cool temperature;

locating the barrel in a desired location so that children can withdraw individual chilled milk cartons; and subsequently separately removing the flat panels from the cavity and refreezing the panels after they have been removed from the cavity.

13. The method of claim 12 further comprising:

replacing a thawed panel with a frozen panel without disturbing the milk cartons.

14. The method of claim 12 further comprising:

moving the insulated vessel on casters on the bottom thereof.

15. The method of claim 12 wherein said depositing step precedes said placing step.

16. A method of vending a chilled item in a sales environment comprising:

providing an insulated vessel having an internal, upwardly-open cavity;

freezing flat panels that are shaped and sized to fit along peripheral portions of the cavity;

placing the flat panels in the cavity along peripheral portions of the cavity to form a reduced cavity substantially entirely bounded by frozen panels, depositing a crate packaged with the item to be vended within the reduced cavity, thereby storing the items at a cool temperature; and locating the barrel in a desired location so that customers can withdraw individual chilled items for purchase; and subsequently separately removing the flat panels from the cavity and refreezing the panels after they have been removed from the cavity.

17. A chilled item server comprising:

an outer barrel formed of thermoplastic having a generally cylindrical shape, substantially vertical sides, a generally flat, closed bottom, and an open top having an annular ledge and a generally square opening shape;

an inner liner fitted within the outer barrel formed of thermoplastic having a generally elongated truncated pyramidal shape, a generally flat bottom, an open top with an extended rim formed to complement the generally square opening shape of the outer barrel and to rest on the annular ledge;

a chamber located between the inner liner fitted within the outer barrel containing preformed polystyrene foam;

at least one freezer panel of appropriate size and shape to fit within the inner liner, said at least one freezer panel formed of thermoplastic material and arranged in a syncline and having a cavity within the at least one freezer panel said cavity containing 2% saline solution;

casters mounted to the generally flat, closed bottom of the outer barrel; and graphics printed on styrene that is wrapped and secured to the outer barrel, whereby beverages placed within the server are subjected to a cool atmosphere created within the server by the at least one panel and thereafter maintained at an effectively chilled temperature for consumption.

18. A server for chilling and vending milk comprising:

an outer vessel with a rim;

an inner liner fitted within the outer vessel having a rim in communication with the rim of the outer vessel thereby creating a chamber between the inner liner and outer vessel;

insulating material within the chamber; and a plurality of separately removable panels positioned within the inner liner generally vertically around a perimeter of a cavity, said panels being freezeable with a slow rate of thaw and arranged to define a boundary substantially entirely around the cavity and further comprising means thereon to facilitate removal thereof from the server for refreezing.

19. The server of claim 18 further comprising:

casters mounted to a bottom portion of the outer vessel.

20. The server of claim 18 wherein the insulating material within the chamber is preformed polystyrene foam.

21. The server of claim 18 further comprising:

a plurality of bosses on each of the plurality of panels such that the indentations prevent bowing of the panels upon sequential freezing and thawing.

22. The server of claim 18 wherein the outer vessel has an upwardly open cavity, a closed bottom, and peripheral side walls.

23. The server of claim 22 wherein the inner liner conforms with the upwardly open cavity of the outer vessel and is configured to receive substantially square crates packed with the milk to be chilled and vended within the cavity.

24. The server of claim 23 wherein the inner liner has an inner surface extending downwardly to a closed bottom whereby a plurality of the substantially square crates packed with milk are stackable within the inner liner.

25. The server of claim 23 wherein the outer vessel has a height in the region of 26 inches and the inner liner has a width of about 15⅝ inches and a depth of about 21¾ inches.

26. A server for vending and chilling milk comprising:

a polyethylene shell having an outer covering, an inner liner fitted within the outer covering, an upwardly open cavity, substantially vertical sides, and a generally flat, closed bottom;

a chamber located between the inner liner and the outer covering containing insulating foam;

a plurality of freezer panels configured to fit within the inner liner to form vertical walls about the perimeter of the upwardly open cavity;

casters mounted to the generally flat, closed bottom of the shell; and graphics displayed on the shell;

wherein the upwardly open cavity of the shell is configured to receive substantially square crates packed with the milk to be chilled and vended within the upwardly open cavity; and wherein the milk placed within the server is subjected to a cool atmosphere created within the server by the plurality of freezer panels and thereafter maintained at an effectively chilled temperature for consumption.

* * * * *

UNITED STATES PATENT AND TRADEMARK OFFICE

CERTIFICATE OF CORRECTION

PATENT NO. : 6,067,810

DATED : May 30, 2000

INVENTOR(S) : Thomas A. Jennings, et al.

It is certified that error appears in the above-indentified patent and that said Letters Patent is hereby corrected as shown below:

In Claim 7, line 4, "to" should be --top--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,067,810
DATED : May 30, 2000
INVENTOR(S) : Thomas A. Jennings, et al.

It is certified that error appears in the above-identified patent and that said Letters Patent is hereby corrected as shown below:

Claim 7,
Line 4, "to" should be -- top --.

Signed and Sealed this

Second Day of October, 2001

*Attest:*

Nicholas P. Godici

NICHOLAS P. GODICI
*Acting Director of the United States Patent and Trademark Office*

*Attesting Officer*